US005749491A

United States Patent [19]

Wylder et al.

[11] Patent Number: 5,749,491

[45] Date of Patent: May 12, 1998

[54] REUSABLE COVER FOR RENDERING A CONVENTIONAL REUSABLE DRINKING CONTAINER SPILL RESISTANT

[76] Inventors: Robert N. Wylder, 7018 Fernhill Dr., Malibu, Calif. 90265; Martin C. Steinbrecher, 462 Orsett St., Chula Vista, Calif. 91911

[21] Appl. No.: 672,950

[22] Filed: Jul. 1, 1996

[51] Int. Cl.[6] ..... A47G 19/22

[52] U.S. Cl. ..... 220/719; 215/387; 220/323; 220/324; 220/703; 220/789

[58] Field of Search ..... 222/479; 215/386, 215/387; 220/323, 324, 703, 704, 716, 719, 789, 790, 792, 212.5

[56] References Cited

U.S. PATENT DOCUMENTS

| | | | |
|---|---|---|---|
| 3,360,161 | 12/1967 | Smith | 220/719 |
| 3,595,421 | 7/1971 | Sanchis | 222/479 X |
| 3,944,112 | 3/1976 | Miller | 220/704 |
| 4,124,138 | 11/1978 | Saliba et al. | 220/704 |
| 4,303,170 | 12/1981 | Panicci | 215/387 X |
| 4,305,533 | 12/1981 | Wightman et al. | 220/719 X |
| 5,217,141 | 6/1993 | Ross . | |
| 5,249,703 | 10/1993 | Karp . | |
| 5,573,130 | 11/1996 | Chanal et al. | 220/212.5 |
| 5,573,139 | 11/1996 | Yeh | 215/387 X |
| 5,586,676 | 12/1996 | Lynd | 220/387 X |
| 5,613,616 | 3/1997 | Monus | 220/212.5 X |

*Primary Examiner*—Allan N. Shoap
*Assistant Examiner*—Robin A. Hylton

[57] ABSTRACT

A cover for drinking containers, and which includes a generally flat, circular disk-shaped body having two laterally projecting seal flanges. A firm body portion is sized smaller than the interior diameter of an applicable drinking container while the outward projecting annular seal flanges extend to make the overall body slightly larger in diameter than the interior diameter of the drinking container to serve as fluid seals and as frictionally adhesive members which engage the interior sidewall of the container to assist in stabilizing the cover. The top surface of the body is affixed with two oppositely disposed outward projecting flexible extending arms which extend outward beyond the sealing flanges. The arms each support a terminal end stop hook. When the cover is inserted into the open top end of a drinking container, the arms are folded upward, the folding being the result of the arms engaging the top interior lip of the drinking container, and being bent upward as the body with peripheral flanges is moved downward into the container. Upon sufficient insertion of the body with seal flanges, the stop hooks are automatically hooked atop the rim of the container. The stop hooks atop the container top lip prevent the cover from being pressed too far into the container, and serve as exposed handles for removing the cover. A beverage dispensing notch and air vent are provided in the cover.

8 Claims, 4 Drawing Sheets

REUSABLE COVER FOR RENDERING A CONVENTIONAL REUSABLE DRINKING CONTAINER SPILL RESISTANT

BACKGROUND OF THE INVENTION

1. Field of the Invention

The present invention relates to lids or covers for drinking containers which help prevent spillage of the container contents, and also assist in maintaining the temperature of the contents for a longer period.

2. Description of the Prior Art

Reuseable coffee mugs, cups and drinking glasses, henceforth generally referred to as reuseable drinking containers, are commonly used to hold liquids for drinking either directly from the container or with a straw. Conventional reuseable drinking containers include an annular sidewall with a fixed bottom for holding liquid, and an open top end for filling and dispensing from the container. Such conventional reuseable drinking containers with which this disclosure primarily relates are hand held, and normally of a single serving capacity, although they could be larger, and can be manufactured of rigid ceramics, earthenware, glass, metal, and rigid or generally rigid plastics, and are intended to be washed after use in preparation for re-use. Conventional reuseable drinking containers may or may not include an affixed laterally extending handle structure. Although some plastic reuseable drinking containers are somewhat flexible, generally, conventional reuseable drinking containers are usually quite rigid and durable, as opposed to paper and foam (styrofoam) cups which are inexpensive, non-durable, quite flexible and intended to be disposed of after use. Conventional reuseable drinking containers do not, at least as used in this disclosure, include lids which render the container top opening generally closed and thus resistant to spilling of the container contents, or for keeping the contents of the cups warm or cold for a greater period of time, although some reuseable drinking containers such as beer steins include hinge-attached lids which are generally not removable from the container, and which do not serve well in preventing spills since the lids swing into the open position upon sufficient tipping of the stein.

In the prior art, spill resistant disposable lids such as thin plastic covers for disposable foam and paper cups, which fit over the exterior top edge of the disposable cups are well known and widely used. Such disposable lids are quite specific for given cup top exterior diameters, and thus are normally not attachable to any drinking cups other than the specific diameters and shapes utilized in the disposable cup industry. Additionally, such disposable plastic cup covers normally require an annular lip extending laterally outward at the top exterior of the disposable cup rim, the typical disposable lid including a curved and flexible annular sidewall component for snapping over and then under the annular exterior lip on the disposable cup in order to hold the lid on the cup.

Spill resistant beverage containers commonly called "travel mugs" are well known in the prior art, and are generally affixed with a removable lid, usually if not always, specifically designed for a specific travel mug container only. Removable lids for specialty travel mugs require an integral inwardly extending annular lip inside the interior top area of the mug to abut against to prevent excessive downward insertion of the lid into the mug, and additionally to have downward extending flexible components of the lid hook under to prevent the lid from falling back out the top opening of the mug while tipping the mug to drink therefrom, or alternatively, travel mugs require an integral outwardly extending annular groove or interior recess for proper engagement with the mug, or they cannot be secured in the upper throat of the mug. Generally speaking, conventional travel mug lids of the prior art cannot be used with conventional ceramic coffee mugs or drinking glasses which do not include interior lips and grooves, since absent lips and grooves in the container, there is no structuring allowing adequate securement of the lid in proper position in the conventional reuseable drinking container.

One prior art travel mug was patented by M. Karp on Oct. 5, 1993, U.S. Pat. No. 5,249,703, and teaches a drinking container with an annular interior lip against which the removable lid abuts and forms a leak resistant seal.

Another similar container is shown in U.S. Pat. No. 5,217,141, issued to G. Ross on Jun. 8, 1993. The Ross container is conical in shape having a narrow upper opening modified with a groove into which the removable lid is secured.

Both the Karp and Ross containers are specialized and their respective lids or covers which are specific for the specific containers cannot be used with conventional reuseable drinking containers which do not include grooves and lips in the upper open interior of the container.

Therefore, there is a need for a removable and reuseable lid or cover which can be used on conventional reusable drinking containers of the type having rigid or generally rigid annular sidewalls which are generally straight or slightly tapering from the open top toward the bottom of the drinking containers, for the purpose of preventing spills and maintaining the temperature of the container contents for an extended period of time. We are not aware of any related prior art structures similar to the present invention or offering all of the advantages provided by the present invention.

SUMMARY OF THE INVENTION

The following detailed description is of best modes and a preferred structure for carrying out the invention, and although there are clearly some changes which could be made to that which is specifically herein described and shown in the included drawings, for the sake of brevity of this disclosure, all of these changes which fall within the scope of the invention have not herein been detailed.

The present invention is a cover for engaging a conventional reuseable drinking container, by way of a body of the cover fitting into the top open end of the drinking container. The drinking container or containers can be conventional coffee mugs and many other drinking cups and glasses, and in almost all case are of the single serving size. The present cover renders conventional reusable drinking containers spill resistant, and assists in thermally insulating the liquid of the container. Although not absolutely necessary in order to render the conventional reusable drinking container spill resistant since someone on rare occasion may wish only to transport a beverage absent drinking or spilling, the present cover most preferably includes a relatively small dispensing opening positioned near the interior sidewall of the container allowing the dispensing of beverage so that when the cover is applied to a drinking container, a person can tip the container and drink, or alternatively, a straw can be inserted into the dispensing opening to allow drinking of the container contents through the straw. The present cover does not rely upon internal lips, flanges, grooves or recesses in the interior of the drinking container to function, as these lips and grooves are not likely to exist on the interior sidewall surface of conventional reusable drinking containers.

Most people already own many reusable coffee mugs, cups and drinking glasses, but conventional reusable drinking containers do not include spill resistant covers which would make transporting the container when holding a fluid beverage, such as in a vehicle, less likely to spill the beverage. Many coffee mugs made by numerous different manufactures are about the same size, and since the present invention is easily removable, it can be manufactured in one size which fits many different coffee mugs the consumer most likely already owns.

The present cover includes a body including a generally flat body portion which is preferably plate-like or disk-shaped and annular, since drinking containers are defined in part by annular sidewalls. The body portion is firm or not easily deformable, and includes an outer periphery or side edge which is quite flexible and resilient so as to be resiliently deformable. The firm body portion and resiliently deformable peripheral side edge from one vantage point constituting the overall "body" of the cover, is made of material substantially impervious to the passage of liquid beverages. The flexible and resilient outer periphery of the firm body can be readily defined by numerous structures, and one suitable structure for readily defining the resilient outer periphery is utilizing a laterally outward projecting annular seal flange of thin material supported (attached) by the firm body portion. Two seal flanges are preferred for reasons to herein be given. The two seal flanges are stacked vertically one above the other. The firm body portion is sized slightly smaller in diameter than the interior diameter of the drinking container, while the outward projecting annular seal flanges of the body extending from the firm portion of the body defines the diameter of the cover portion (body) which fits inside the open top of the drinking container slightly larger than the interior diameter of the drinking container. The resiliently deformable periphery, or specifically the seal flanges serve as fluid sealing and frictionally adhesive members which engage or seat tightly against the interior sidewall surface of the drinking container to stabilize the body in the upper open end of the container. The body resides generally horizontally disposed in the container when the container is in the up-right position, or in other words, spanning across the container top opening to in effect seal the opening with the exception of the preferred dispensing opening and a small vacuum-break vent opening in the body. The use of two seal flanges, one above the other, as opposed to one flange, provides for increased surety in fluid sealing and gripping of the container sidewall, particularly when the sidewall is slightly dimpled or out-of-round, which is a condition fairly common on fired ceramic mugs. One seal flange would function within the scope of the invention, and could conceivably be a single thin seal flange or a single relatively thick seal flange provided this thick flange was adequately deformable and resilient. The top exposed surface of the body is affixed with or supports two oppositely disposed (straight across from one another) outward projecting flexible extending arms which extend outward beyond the lower in-use positioned sealing flanges. The extending arms each support or terminate in a downward depending L-shaped bracket or stop hook. When the body is inserted into the open top end of a drinking container, the extending arms are bent or folded upward about 90 degrees from there normal relaxed position, the folding or bending being the result of the arms engaging the top interior rim surface of the drinking container, and being pushed upward as the body with peripheral flanges is moved downward into the container. The bending of the arms can be caused in full or in part by the installing person gripping the cover with both hands wherein each thumb is placed atop the top surface of the body adjacent the extending arms, and the index fingers adjacent each thumb positioned underneath each respective adjacent hook, with the extending arm and hook squeezed between the thumb and index finger, with these hand and finger positions allowing good thumb pressure to be applied to press the body into the container while at the same time bending the extending arms upward and utilizing the hands and fingers to guide and stabilize the cover during the installation operation. Upon sufficient insertion of the firm body and seal flanges, the stop hooks are hooked, and automatically so, based on the preferred position thereof, over the top rim of the container when the body is inserted a predetermined distance into the opening of the drinking container. The predetermined distance the cover body is inserted into the container downward toward the container bottom or below the container top rim is determined by the length of the extending arms and positioning of the hooks thereon, and this distance although relatively short, provides clearance for the nose of a person tipping the container to drink directly therefrom, which makes drinking more convenient. The stop hooks resting atop the top lip or rim prevents the cover body from being pressed too far into the container, and signal or in effect inform the installing person that the cover body is fully inserted, as the installing person can visually ascertain when the hooks are fully engaged with the container top rim. The extending arms and hooks also serve as exposed handles which can be grasped between the thumb and fingers and used for pulling the cover from the drinking container.

The central stiff portion of the body is generally rigid or firm in comparison to the more flexible peripheral body side edges which can be readily defined with the flexible seal flanges. The laterally extending arms are also quite flexible. The firm body portion is hard or at least not readily deformed to allow pressing with the fingers (thumbs) on the top of the body during the insertion phase without the body folding or otherwise excessively deforming, and this to allow the insertion of the cover body which in this example utilizes deformation (bending or inward compressing or both) of the flexible and resilient outer periphery (seal flanges) of the otherwise firm body portion. The deformation of the seal flanges requires force, and the firmness of the body portion inward of the deformable outer edge allows the application of this required force, and in an easily controlled manner not allowing the ready tipping of the cover body out of the normal horizontal installation position. The rigidity or firmness of the body helps to provide a good seal by maintaining the seal flanges in proper position within the mug, and allow the seals to be relatively short in extension outward from the firm body portion. The stop hooks also help to maintain and allow the cover to be initially installed horizontally level, whereas if the cover were substantially tipped or bowed, it would leave a gap along one side which would result in excessive leakage.

The cover, including the body with sealing flanges and extending arms with stop hooks or equivalents thereof, preferably manufactured as one integral material piece of rubbery material, such as by plastic injection molding of a thermoplastic elastomer for example, and this can render the cover durable and inexpensive to manufacture, although other manufacturing processes and materials can be utilized. The stiffness or rigidity of the firm body portion is preferably gained by material thickness, compared to the flexibility of the sealing flange and extending arms which are relatively thin and thus significantly more flexible than the firm body. The stop hook portions are relatively stiff, defined by relatively thick material so that the hooks are sufficiently stiff, and this to prevent the hooks from easily straightening-out after engaging the upper rim of a drinking container during the inserting of the cover into the container.

The cover also includes the dispensing opening located along the outer edge of the body, preferably at a right angle or 90 degrees around from the extending arms with stop hooks, and this so the hooks do not interfere with placing of the person's lips on the container rim directly above the dispensing opening for drinking. The dispensing opening is also preferably sufficiently large for passage of a standard straw. The dispensing opening which is preferably defined as a side edge notch is generally a termination of the seal flanges across a short distance, plus, an inward further material removal in the firm body in the short distance where the seal flanges have been terminated. There is a small opening through the body of the cover for venting which helps reduce the vacuum effect when removing the contents of the container, therefore allowing the contents to more freely flow when drinking from the drinking container. The vent opening is a distance from the dispensing opening and preferably straight across the diameter of the body from the dispensing opening so as to not be blocked by the beverage when the container is tipped toward the dispensing opening for drinking.

The cover body with seals flanges, and the flexibility of the seal flanges allow the cover to be manufactured compatible with drinking containers which are absent interior lips and grooves. The most common sizes of coffee mugs in the U.S.A. are for holding approximately 11 or 12 fluid ounces of beverage. Since most existing coffee mugs fall into this size range, then the present spill resistant cover can be made in one or two sizes which will fit the majority of the conventional reuseable coffee mugs in the U.S.A. Other specific sizes of the present cover can also be provided for other particular types and sizes of drinking containers. The present lid or cover can be manufactured to fit any desired size of drinking container such as a slender cold-drink glass and the like.

The small size and light weight of the cover allows it to b e easily stored, such as in a glove compartment of a vehicle, or placed in an automatic dishwasher. Since it is flexible and durable, there is little danger of damaging the cover during use or storage, and since it is prefer ably provided as a one-piece unit there are no accessory parts to become misplaced and lost. The generally broad flat surface of the top plate-like surface of the cover body is also well suited for the application of graphics by printing, embossing, stickers, molding or otherwise decorating, which makes it an ideal location for advertisements, product logos or art work. The preferred materials from which to manufacture the present cover are safe for direct contact with food for human consumption. The nature of generally any covering over the top of a drinking container slows thermal transference between the beverage in the container and the ambient air around the container, and the relatively thick nature of the preferred cover body functions very well for this purpose, and thereby helps maintain cold beverages cold for a longer period, and hot beverages remain hot longer when the cover is in place.

These, as well as other objects, attributes and advantages will become increasingly appreciated with continued reading and with review of the included drawings.

DESCRIPTION OF A PREFERRED EMBODIMENT

Figure 1:
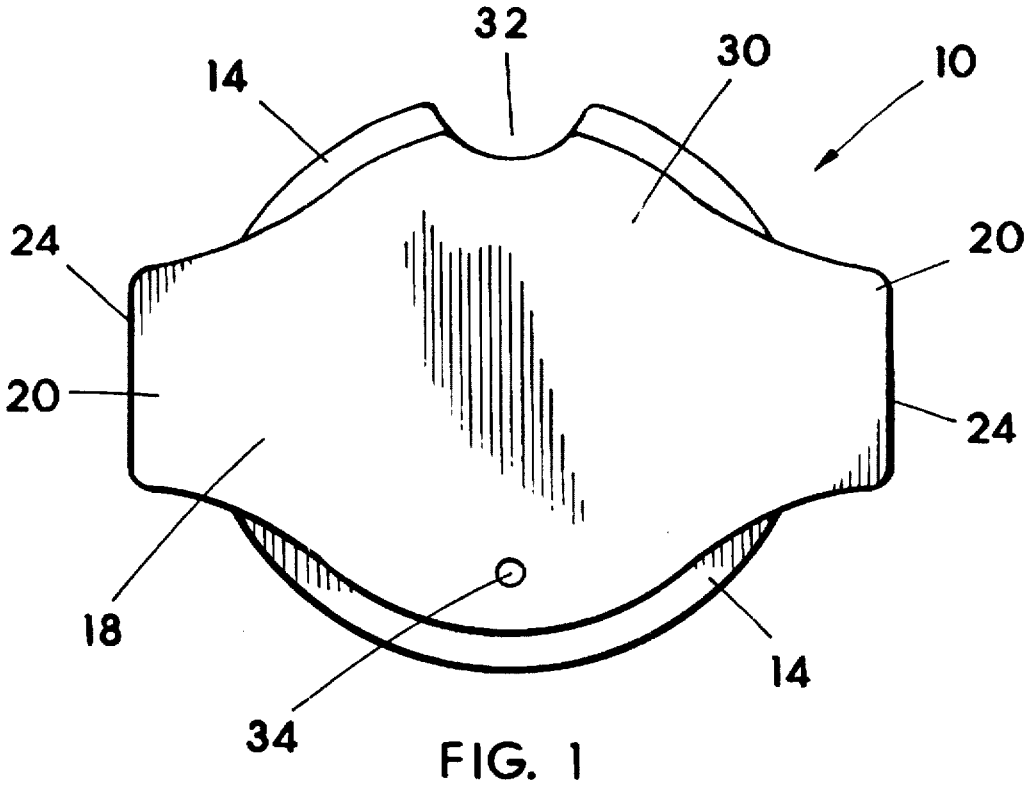
FIG. 1 is a top plan view of a cover for rendering a beverage container spill resistant in accordance with the present invention.
Figure 2:
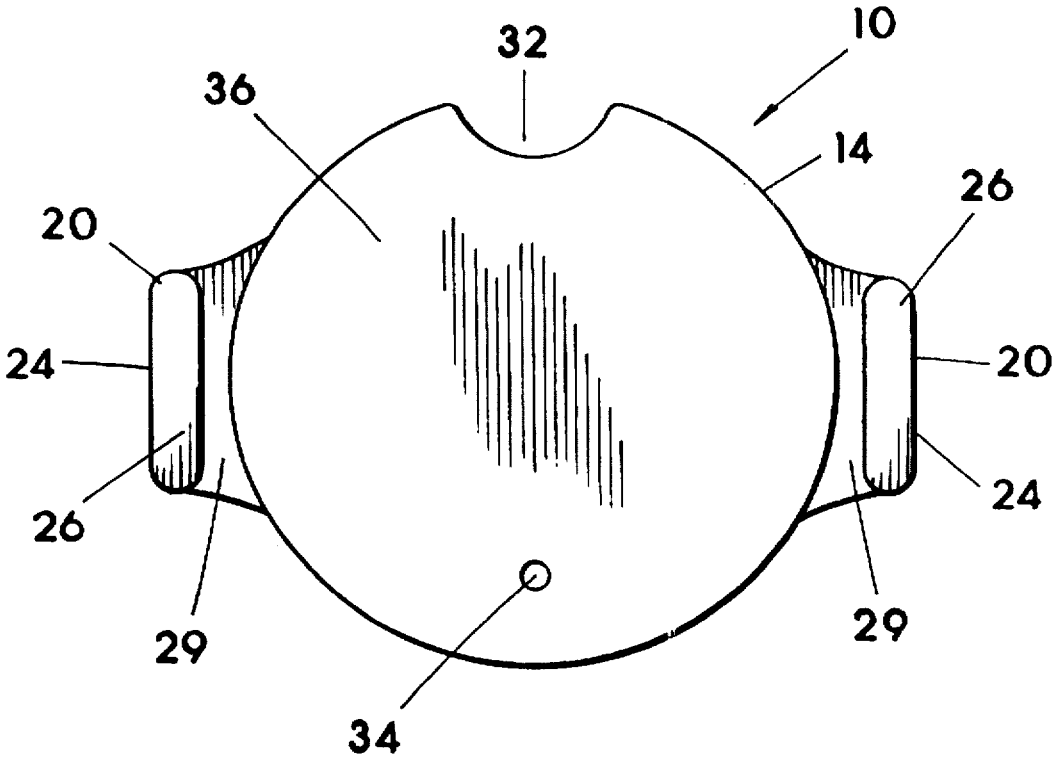
FIG. 2 is a bottom plan view thereof.

Referring now to the drawings where an example of a preferred embodiment of the cover 10 for rendering a conventional reusable drinking container spill resistant is illustrated. The dimensions given in this "Preferred Embodiment" section in terms of inches or portions of inches are for example only, as we do not wish our invention to be restricted to these dimensions given only to further ensure those skilled in the art will be readily able to build and use at least one embodiment in accordance with the present invention. Additionally, for the sake of brevity, only one preferred embodiment is shown in the drawings and the following detailed description is generally mostly specifically directed toward this one preferred embodiment, although some of possible changes which could be made within the scope of the invention will be briefly detailed. Cover 10 is preferably entirely manufactured of direct food contact approved rubbery material, such as a thermoplastic elastomer, such as that sold under the tradename SANTOPRENE, by Monsanto Chemical Co. of Saint Louis, Mo., U.S.A. Other suitable materials can also be used to form cover 10, such as silicone rubber for example, if approved for direct contact with food for human consumption. The rubbery material can be provided in a variety of colors and is suitable for printing or otherwise decorating for advertisements or art work. Cover 10 is preferably manufactured as a one piece unit such as with plastic injection molding techniques, however affixment of separate members is also acceptable such as with direct food contact approved adhesives or sonic heat bonding for example. Cover 10 is ideally suited for use with coffee mugs, however it can be provided in varying sizes to fit any sized drinking glass, cup or mug having a circular interior sidewall.

In the specific example shown in the drawings, cover 10 includes a cylindrical disk-shaped firm or stiff body portion 12 having two flat annular seal flanges 14 extending from the outer annular narrow edge wall of body portion 12 as shown well in FIGS. 1–4. From one vantage point the firm body portion 12 and the flexible resilient flanges 14 together or combined constitutes the "body" of the cover, however, from another vantage point just the firm body portion 12 can be viewed as the "body" and the flexible resilient flanges 14 as separate components attached to the firm body portion 12, but from either vantage point, firm body portion 12 and flanges 14 insert as in integral unit into the interior of the drinking container 40.

Figure 5:
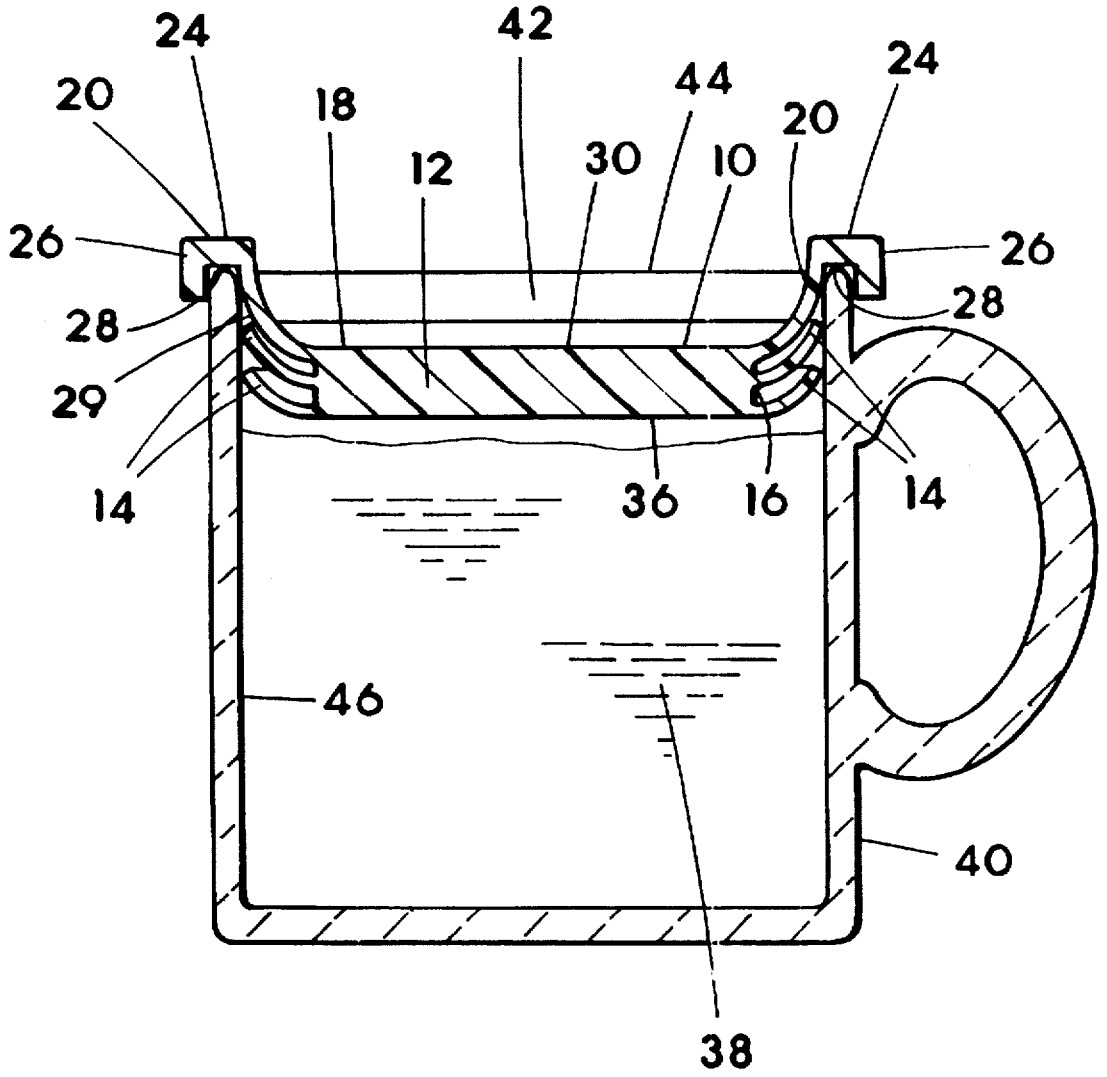
FIG. 5 is a cross sectional view showing the spill resistant cover in use inserted into a conventional reusable coffee mug.
Figure 6:
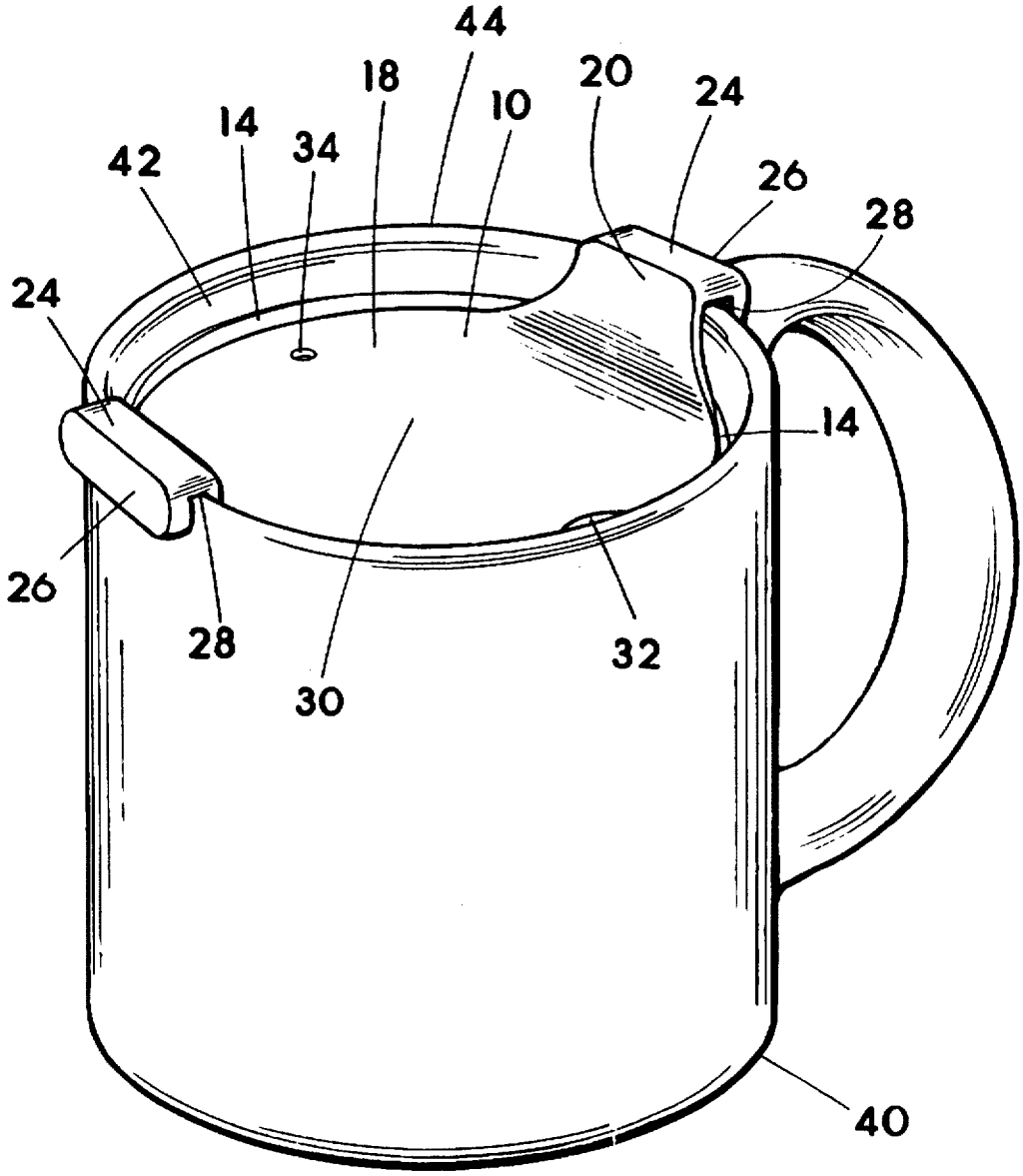
FIG. 6 illustrates the spill resistant cover of FIG. 1 applied to the coffee mug of FIG. 5 from a top perspective view.

The body portion 12 is sized slightly smaller in diameter than the interior diameter of the annular sidewall 46 of the drinking container 40, while the outward projecting annular seal flanges 14 extending from the body portion 12 define the overall body diameter slightly larger than the interior diameter of the drinking container 40. Depending upon the overall size of the body of cover 10 which is determined by the interior diameter near the top of the container 40 into which the body is manufactured to fit, seal flanges 14 can extend about ⅛ to ⅜ inch laterally outward beyond the terminal edge of body portion 12 for use of cover 10 with 11 or 12 fluid ounce size coffee mugs for example. Container 40 in FIGS. 5 and 6 for example, can be considered an 11 fluid ounce holding mug, and which has an internal diameter circular top opening of roughly 2⅞ inches. A body portion 12 of about 2¼ inches with flanges 14 extending outward about body portion 12 another ⅜ inches, which means ⅜ inches on one side of body portion 12, and ⅜ inches on the other side straight across, defines a body with peripheral flanges having a diameter of about 3 inches, and this 3 inch overall body with flexible flanges 14 can be inserted into the mug of FIGS. 5 and 6 wherein the body portion 12 which is firm or hard does not interfere with the insertion, and the flanges 14 engage the top lip of the mug and somewhat fold upward and compress inward with the manual pressure used to force the body into the top opening of the mug 40. The flanges 14 are somewhat frictionally adhesive, but with manual pressure applied to the top surface, the body portion 12 and flanges 14 can be pushed into the mug opening. The frictionally adhesive qualities and resilient nature of flanges 14 against the interior sidewall of the mug will retain the cover 10 against falling out of the mug when the mug is tipped for drinking, or when the mug is tipped-over accidentally. The thickness of body portion 12 in cross section as shown in FIG. 5 might be about ¼ to ½ inches for example.

Figure 3:
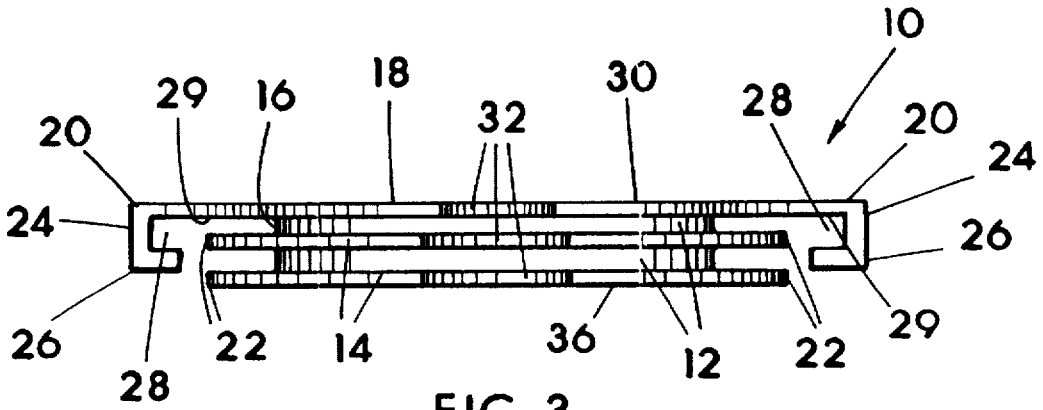
FIG. 3 is a front elevational view thereof.
Figure 4:
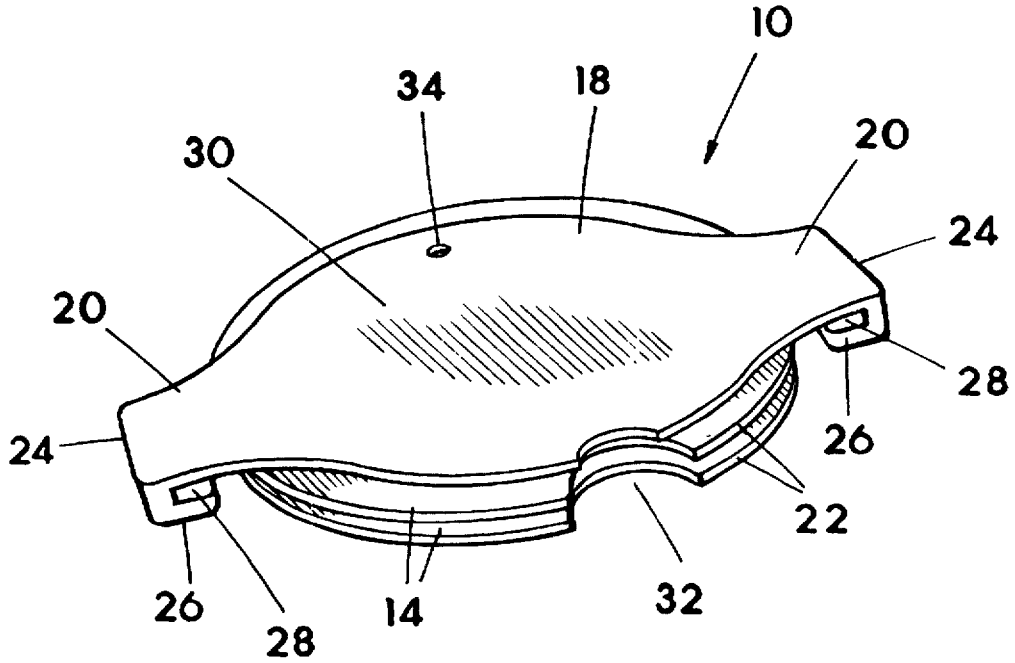
FIG. 4 is a top front perspective view thereof.

The bottom flange 14 connected to or supported by body portion 12 extends from the bottom edge of sidewall 16 of body portion 12, with the second or upper flange 14 connected to or supported by body portion 12 extending from approximately the center of wall 16 of body portion 12. The two flanges 14 are spaced apart from one another as best shown in FIG. 3 to allow the lower flange 14 to begin bending during the initial installation prior to the upper flange 14 receiving any substantial bending force, an arrangement which allows the initial aligning and starting of the cover 10 into a container 40 to be quite easy, as compared to one flange of sufficient retention strength which would require deformation of the flange basically all at once during the initial stages of installing the body into a container 40. Thus two flanges 14 allow easy initial starting, and the combined frictional adhesive retaining force of the two flanges once inside the container 40 provided good securement and stability of the cover in the container. Shown affixed to the top surface of body portion 12 is a flat flexible plate 18 having two oppositely disposed outward projecting planar extending arms 20 extending outward beyond the peripheral edges 22 of flanges 14. The arms 20 can be viewed simply as lateral, thin extensions of body portion 12, as can flanges 14. Each extending arm 20 is shown as an integral continuation of plate 18 with the sides of extending arms 20 gradually curving downward from one side of plate 18 and upward from the opposite side of plate 18 to terminate at a distal end 24 which is a straight edge approximately 1 inch in length. Both ends 24 are positioned parallel to one another. Connected to and extending downward from the bottom surface of the terminal ends 24 of each extension 20 is an L-shaped bracket or stop hook 26 which extends the length of the end 24. An open channel 28 formed between the upper surface of the inwardly angled L-shaped stop hook 26 and the bottom surface 29 of plate 18 is positioned facing the outer edge 22 of flanges 14 when the arms 20 are in the normal or relaxed condition not in use as shown in FIG. 3. The flat top surface 30 of the body is generally smooth and flat and large enough in size for displaying graphic or printed information such as logos, art work or advertisements.

A semi-circular shaped dispensing opening 32 is shown formed into the outer edges 22 of both flanges 14, plate 18, and a small section of annular wall 16 of body portion 12. Dispensing opening 32 is preferably located at a right angle to extending arms 20 to avoid interference by hooks 26 with placing one's lip of the mug rim above dispensing opening 32 for drinking directly from the container 40. As an optional feature, dispensing opening 32 may be provided with a removable closing plug which prevents leakage therefrom. Vent opening 34 is shown a small aperture which extends from the top surface 30 of cover 10 to the bottom surface 36 thereof, and is used to prevent the creation of a vacuum when removing the fluid contents 38 (beverage) of container 40. Contents 38 will normally if not always be a drinkable beverage. Vent opening 34 could also be a side notch like that of dispensing opening 32, only preferably smaller than opening 32 since only a very small opening, about 1/16 inch in diameter for example only, is adequate for preventing excessive vacuum build-up, and the smaller the openings in cover 10 the less liquid will spill when the container 40 is accidentally tipped-over. Dispensing opening 32 could be a hole within the scope of the invention, as opposed to the side notch style as shown in the drawings, however a hole is less desirable because it leaves a narrow strip of material between the edge of the hole and the container 40 sidewall which can slow the flow of liquid back into the main beverage chamber after a person has tipped the container and taken a drink from the container. Dispensing opening 32 and vent opening 34 allow fluid, air or beverage to flow from one side of the body to the other, and are defined relatively small to help reduce the amount of spillage if the container 40 is accidently tipped over for a brief period, and to reduce the amount of sloshing of the beverage out of the container such as when the container is carried in an unstable manner, and thus the drinking container is rendered spill resistant.

To install cover 10 on a container 40, bottom surface 36 is positioned over open top end 42 of container 40, preferably with dispensing opening 32 positioned at a right angle to any existing handle on container 40. The beverage should already be in the container 40. Cover 10 is inserted into open top end 42 of container 40, with the user pressing top surface 30 of the firm body portion 12 with the thumbs until extending arms 20 bend upward and channels 28 of stop hooks 26 engage with the upper rim 44 of container 40. Stop hooks 26 serve to prevent cover 10 from being pressed too far into container 40, and they also serve as handles for easy removal of cover 10 from container 40. Although preferred for a more secure affixment to the top rim of the container, hooks 26 need not absolutely include the downward extending short extension shown on the outside of the container as shown in FIG. 5, but could be structured to just rest atop the rim of the container. The recession of top surface 30 of the body below rim 44 of container 40 is an advantage in that it provides clearance for the user's nose while drinking, and also provides sidewall of the container 40 above the top of the cover body so that any liquid which comes to rest on the top of the cover will be contained in the upright container, and will likely flow through opening 32 or 34 back into the beverage chamber underneath the bottom of the cover body.

When cover 10 is inserted downward into container 40, the cover 10 being forced downward in the direction of the bottom of the container, flanges 14 bend upward as edges 22 frictionally and sealingly engage the interior surface of annular sidewall 46 of container 40 since the overall diameter of the body is slightly larger than the interior diameter of container 40, thereby creating a frictionally tight fit which is quite leak resistant, leaving only the relatively small openings of dispensing opening 32 and vent opening 34 through which liquid can exit.

To remove cover 10 from container 40, hooks 26 on extending arms 20 are simply grasped with the fingers and lifted upward. It may be easier to overcome the frictional fit of flanges 14 against the interior of container 40 by using a back and forth pulling or in other words by lifting one hook 26 first, then after the frictional engagement is somewhat released on one side, the remaining hook 26 can be lifted.

Although not shown in the drawings, a third bendable extending arm with hook like the first two arms and hooks, positioned between the first two arms 20 with hooks 26, extending outward parallel to the top surface 30 of cover 10 and straight across from the dispensing opening could be utilized to possibly increase stability, but is not seen as necessary when compared to the additional cost of applying this third arm with hook, considering two arms with hooks straight across from one another provide good stability, a good visual gage indicating complete installation, and very suitable structures to grasp when installing and removing cover 10. Within the scope of the invention, the extending arms 20 with stop hooks 26 can be manufactured to normally reside in the upward position, and be flexible or fairly rigid, and thus requiring little or no bending during the insertion of the cover 10 in the container 40, however this renders close stacking or nesting for shipping of many of the covers 10, one on top of another, more difficult. If the invention is manufactured with the extending arms normally residing in the raised position, or in other words, extending generally perpendicular relative to the wide flat top surface of body portion 12, the two extending arms 20 could in effect be defined as a single raised arm curving around the majority or about half-way around of the body and extending perpendicular thereto, and this long, curved extending arm structure would include one long hook structure or multiple hook structures which would serve the same functions as hooks 26. Conceivably, dual plastics injection molding with the appropriate tooling for accepting two plastics could be used to define the firm body portion from one type of hard-setting plastics material, and the outer resilient and deformable peripheral side edge from a second type and very soft and rubbery plastics material. The firm body portion could be made of a rigid material, and have a rubbery elastic O-ring seal applied about the body and affixed in a side edge groove of the firm body portion, or possibly affixed in place with mechanical fasteners or glues, to serve as the resilient deformable seal, wherein in this arrangement, the dispensing opening and the vent opening would most likely be most feasibly defined as holes in the firm body portion and not interrupting the annular unbroken O-ring seal, although the openings (dispensing and vent) could be notches in the side edge of the firm body portion which the O-ring seal simply spans across.

It is believed the invention has been described and shown for example in sufficient detail to allow those skilled in the art to build and use and least one structural embodiment in accordance with the present invention without having to resort to undue experimentation, however, it must be understood that some changes in the specific structures and methods of use described and shown in the drawings can be made without departing from the true scope of the invention in accordance with the appended claims.

What we claim as our invention is:

1. An engageable, removable and reusable cover for use on a conventional reusable drinking container for rendering the drinking container spill resistant;

said cover comprising, a disk-shaped body of fluid impervious material for insertion into and spanning across an open top interior of the drinking container; said disk-shaped body including a relatively stiff central portion and a readily deformable flexible and resilient lateral side periphery extending outward from said stiff central portion; said stiff central portion sized smaller in diameter than the open top interior of the drinking container; said disk-shaped body having an overall diameter larger than the open top interior of the drinking container; said disk-shaped body sized to be insertable into the open top interior of the drinking container wherein said stiff central portion supports said lateral side periphery tightly abutting against and frictionally adhering to an annular sidewall interior surface of the drinking container;

multiple extending arm members each connected to said disk-shaped body and each having a relaxed condition of extending laterally outward beyond said disk-shaped body; said extending arm members each made of resilient flexible material readily bendable with bending force for allowing upward positioning of said extending arm members to allow insertion of said disk-shaped body into the drinking container with said extending arm members bent upward; said extending arm members each sufficiently resilient to return, absent applied bending force, to said relaxed condition of extending laterally outward beyond said disk-shaped body; said extending arm members each having a distal end with the distal ends in spaced relationship to one another and to said disk-shaped body; said extending arm members each supporting a hook structure, one said hook structure on the distal end of each of said extending arm members with the hook structures in spaced relationship with one another, the hook structures positioned on said extending arm members so as to be restable atop an upper rim of the drinking container when said extending arm members are bent upward with said disk-shaped body inserted into the drinking container and recessed below the upper rim, whereby the hook structures can be abutted against the upper rim of the drinking container for serving as stops for aiding in determining a suitable distance said disk-shaped body is insertable downward into the drinking container below the upper rim;

a dispensing opening through said disk-shaped body for allowing access to beverage within the drinking container when said cover is engaged with the drinking container; said dispensing opening positioned in spaced relationship from each of said extending arm members and substantially off-centered of said. disk-shaped body so as to be adjacent the annular sidewall interior surface of the drinking container when said cover is engaged with the drinking container;

a vent opening through said disk-shaped body for preventing a vacuum within the drinking container when said cover is engaged with the drinking container.

2. A cover in accordance with claim 1 wherein said lateral side periphery includes multiple laterally extending flanges of flexible and resilient rubbery material;

said flanges positioned one above the other and in spaced relationship to one another.

3. A cover in accordance with claim 2 wherein said disk-shaped body, said extending arm members and the hook structures are all integrally formed of molded rubbery material, and said stiff central portion of said disk-shaped body is made relatively stiff by a thicker structuring of said rubbery material compared to a thinner structuring of said rubbery material defining said flanges and said extending arm members.

4. A cover in accordance with claim 3 wherein said cover is generally flat, to allow compact storage and shipping thereof, when said extending arm members are in said relaxed condition of extending laterally outward beyond said disk-shaped body.

5. A cover in accordance with claim 4 wherein said dispensing opening is positioned at least in part through said lateral side periphery of said disk-shaped body.

6. A cover in accordance with claim 5 wherein said vent opening is positioned a distance away from said dispensing opening and across said disk-shaped body from said dispensing opening.

7. A cover in accordance with claim 6 wherein said rubbery material is a thermoplastic elastomer.

8. A cover in accordance with claim 7 wherein said disk-shaped body includes a flat top surface area suitable for applying graphics thereon.

* * * * *